United States Patent [19]

Becker et al.

[11] Patent Number: 4,493,660

[45] Date of Patent: Jan. 15, 1985

[54] SHIP HAVING AT LEAST ONE PROPELLER NOZZLE UNIT WITH RUDDER IN OPTIMUM POSITION

[75] Inventors: Willi Becker; Karl Johannsen, both of Hamburg, Fed. Rep. of Germany

[73] Assignee: Willi Becker Ingenieurbüro GmbH, Hamburg, Fed. Rep. of Germany

[21] Appl. No.: 275,607

[22] Filed: Jun. 22, 1981

Related U.S. Application Data

[63] Continuation-in-part of Ser. No. 18,313, Mar. 7, 1979, abandoned.

[30] Foreign Application Priority Data

Mar. 7, 1978 [DE] Fed. Rep. of Germany ..... 2809662

[51] Int. Cl.[3] ..... B63H 1/28

[52] U.S. Cl. ..... 440/67; 114/163; 114/166

[58] Field of Search ..... 440/66, 67, 42; 114/166, 163; 60/221, 222; 239/227, 265.35; 222/533

[56] References Cited

U.S. PATENT DOCUMENTS

| | | | |
|---|---|---|---|
| 2,698,664 | 1/1955 | Freeman | 239/227 X |
| 4,085,694 | 4/1978 | Schilling et al. | 440/67 X |
| 4,163,546 | 8/1979 | Morris et al. | 239/227 X |

FOREIGN PATENT DOCUMENTS

| | | | |
|---|---|---|---|
| 617775 | 3/1936 | Fed. Rep. of Germany . | |
| 2346035 | 3/1974 | Fed. Rep. of Germany . | |
| 2246766 | 3/1974 | Fed. Rep. of Germany | 440/67 |
| 2809662 | 9/1979 | Fed. Rep. of Germany . | |
| 140053 | 4/1953 | Sweden | 440/67 |

OTHER PUBLICATIONS

"Ship Construction Techniques", East Germany, 12, 1961, pp. 610–618.

*Primary Examiner*—Sherman D. Basinger
*Attorney, Agent, or Firm*—Toren, McGeady and Stanger

[57] ABSTRACT

A marine vessel propulsion assembly includes at least one propeller nozzle unit having a rudder associated with it. The propeller nozzle unit has a shroud laterally surrounding the propeller and the shroud is supported so that it can be pivoted about two different axes each extending transversely of the flow direction. In the desired angular position, the shroud can be locked in position. The two pivot axes of the shroud extend perpendicular to one another. The shroud is connected to a shaft extending in the direction of one of the pivot axes and the shaft can be interlocked with shaft guide means. The shroud and the rudder each include the same angle of pitch of at least two degrees relative to the propeller shaft.

13 Claims, 7 Drawing Figures

SHIP HAVING AT LEAST ONE PROPELLER NOZZLE UNIT WITH RUDDER IN OPTIMUM POSITION

REFERENCE TO RELATED APPLICATIONS

This is a continuation-in-part of co-pending application Ser. No. 018,313 filed March 7, 1979 now abandoned.

SUMMARY OF THE INVENTION

The present invention relates to at least one propeller nozzle unit with an optimally associated rudder for use on a ship.

It is known to increase the propeller-nozzle thrust with the same output power and a drag resistance that is as low as possible. This applies particularly to high propeller loads such as experienced in ocean-going tugs, fishing vessels, ships in Arctic seas, thrust-exerting vessels and the like.

To achieve this purpose, it has been known to provide a rigid arrangement of nozzles with rotational or axial symmetry at the stern of a ship with the nozzles coaxial with the propeller shaft so that the nozzles can be optimized substantially only for forward movement and/or for backward movement. Such nozzles are known as KORT nozzles. This coaxial arrangement of the nozzle with respect to the propeller shaft is only the most favorable arrangement for the freely traveling propeller nozzle. In a wake field behind the ship, however, transverse components occur in the velocity field which do not permit the maximum possible thrust gain with a coaxial arrangement of the nozzles relative to the propeller shaft.

Therefore, it is a primary object of the present invention to provide a novel and improved propulsion assembly for ships.

It is another object of the present invention to reduce the nozzle inlet losses by an optimum pitch of the nozzles relative to the wake field.

Still another object of the present invention involves the possibility of correcting or improving the pitch of the nozzle based on theoretical predictions or on test results, by reasonable means, even during a full scale test upon completion of the ship.

A still further object of the present invention is to assure that the above hydrodynamic advantage of the nozzle does not impede or obstruct the dismounting of the propeller.

In accordance with the present invention, at least one propeller nozzle unit with an optimally associated rudder is provided for a ship. The propeller nozzle unit includes a nozzle type shroud encircling the propeller and pivotally mounted for movement about two substantially perpendicular axes each extending transversely of the longitudinal axis of the propeller. Moreover, the structure supporting the shroud is arranged so that the shroud can be locked in a position required for achieving a maximum of the integral of the velocity field established across the entry area in the direction of the nozzle axis.

By employing this arrangement of the propeller nozzle unit and rudder, a further increase of thrust can be attained with the same fuel consumption. Further, an increase of the pile traction and of velocity is obtained. As a consequence, with unmodified propulsive output it is possible to increase the range of action or of the payload of the ship. In the case of ocean-going tugs it is possible, using the present invention, to gain time in an emergency. In certain instances it is possible to achieve savings in fuel energy with an improved adaptation of the main engine power to the propeller power requirement so that unfavorable operation at partial load is avoided with a resultant increase in useful life. By adjusting the pitch of the nozzle in accordance with the present invention it is possible to achieve a reduction in the non-uniformity of the velocity field in the inflow region of the nozzle with a resultant reduction in the generation of cavitation and vibrations. By offsetting the rudder relative to the axial direction of the propeller shaft, rudder resistance can be reduced to a minimum in the zero position of the rudder. Furthermore, it is possible to dismount the propeller shaft without removing the rudder or any of its parts despite a largely concentric arrangement of the propeller in the rudder jet.

The shroud can be mounted in a number of ways so that it can be pivoted about two substantially perpendicular axes both extending transversely of the axial direction of the propeller shaft. In one preferrred embodiment, the shroud is mounted in a yoke which, in turn, is fixed to a vertical shaft. By rotating the shaft the shroud can be pivoted about a vertical axis. The shroud is connected to the yoke on a horizontal axis. A drive unit is mounted on the shaft so that it can pivot the shroud about the horizontal axis.

In another embodiment a ball joint mounts the shroud to the lower end of the vertical shaft so that the shroud can be pivoted about the two perpendicularly arranged axes.

It is particularly advantageous, in accordance with the present invention, that the nozzle-type shroud encircling the screw can be connected to the ship's body by a rotatable tubular control shaft so that the shroud can be locked in position. Due to this design, it is a simple matter to adjust the pitch of the nozzle. Furthermore, there result possibilities of correction in the full scale design.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
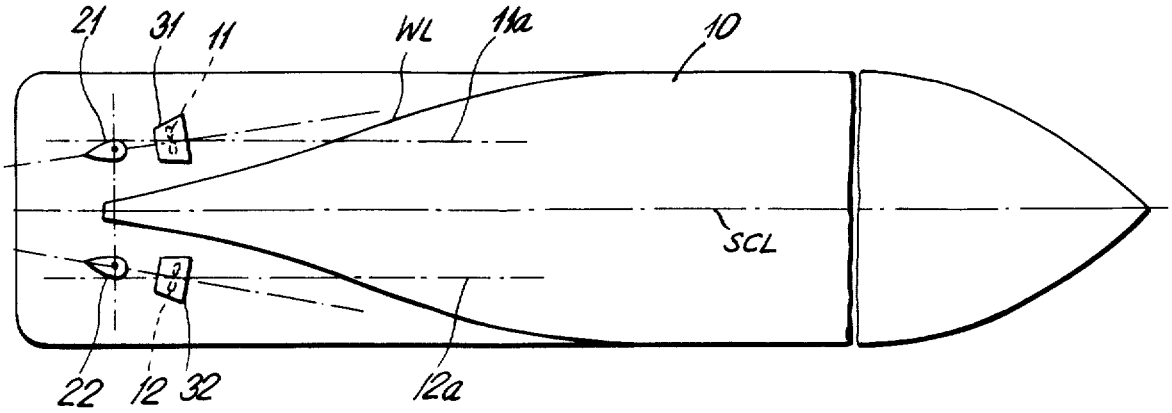
FIG. 1 is a bottom view of a twin screw ship having two rudders and nozzles adapted to be angularly adjusted.

In FIG. 1 the bottom of a ship's body 10 is illustrated with two laterally spaced screws 11, 12 adjacent its stern. As viewed in FIG. 1 the right-hand end of the body 10 is the bow and the left-hand end is the stern. Each screw is mounted on a generally horizontally extending propeller shaft 11*a*, 12*a* which, in turn, is connected to motive means within the ship's body, not shown. The dot-dashed lines representing the propeller shafts 11*a*, 12*a* are illustrated with prolongations extending rearwardly from the screws, the propeller shafts, however, do not extend rearwardly from the propeller screws. Laterally offset from these prolongations inwardly toward the ship's center line SCL are rudders 21, 22 each associated with one of the screws.

Each screw 11, 12 is encircled by a nozzle-type shroud 31, 32 with the axis of the shroud extending in the general direction of the propeller shaft. Since both shrouds 31, 32 are of the same design and are arranged in the same manner, the following description is limited to the shroud 32.

Nozzle-type shroud 32 encircling the screw 12 is rotatably mounted in the ship's body on a control shaft 40. The control shaft 40 is advantageously formed of a tubular design. The control shaft 40 extends substantially perpendicularly of the axis of the propeller shaft 12*a* and forms the first axis of rotation for the shroud 32. The shaft 40 is rotated around its own axis by a drive member DM, shown schematically, and an oblique angular position of the nozzle type shroud relative to the propeller shaft axis is possible. Any of a number of well known drive means can be used to rotate the shaft 40. As viewed in FIG. 2, the direction of water flow through the nozzle-type shroud 32 is indicated by the arrow X. The shroud 32 has a nozzle inlet opening 25 and a nozzle outlet opening 26.

A ball-type joint 42 connects the lower end of the shaft 40 and the shroud 32 so that the shroud can be pivoted about a second or horizontal axis extending perpendicularly of the first axis. The interior of the tubular shaft 40 contains a driving member 42*a* for rotating the ball type joint 42 and the shroud connected to it about the horizontal second axis. The driving member 42*a* can be driven by the drive member DM or by a separate device. The drive member DM by locking the driving member 42*a* locks the ball-type joint 42 and secures the pivotal position of the shroud 32 about the horizontal second axis. Accordingly, depending on the theoretical operating conditions determined for the ship, the shroud 32 can be pivoted about both the first and second axes so that it assumes the desired position for effecting optimum conditions.

The alignment or position of the nozzle-type shrouds 31, 32 and the rudders 21, 22 is effected in agreement with the run of the water line WL at the stern, note FIG. 1. With the pitch of the nozzle-type shrouds 31, 32 adjusted as desired, the position of the shroud can be locked by means of a friction brake member 43 shown schematically in FIG. 2, engageable with the shaft 40. The friction brake member 43 prevents rotation about the vertical first axis and the means not shown for driving the ball joint 42 can be locked by conventional means so that rotation about the horizontal second axis is also locked securing the shroud in the desired position.

Figure 2:
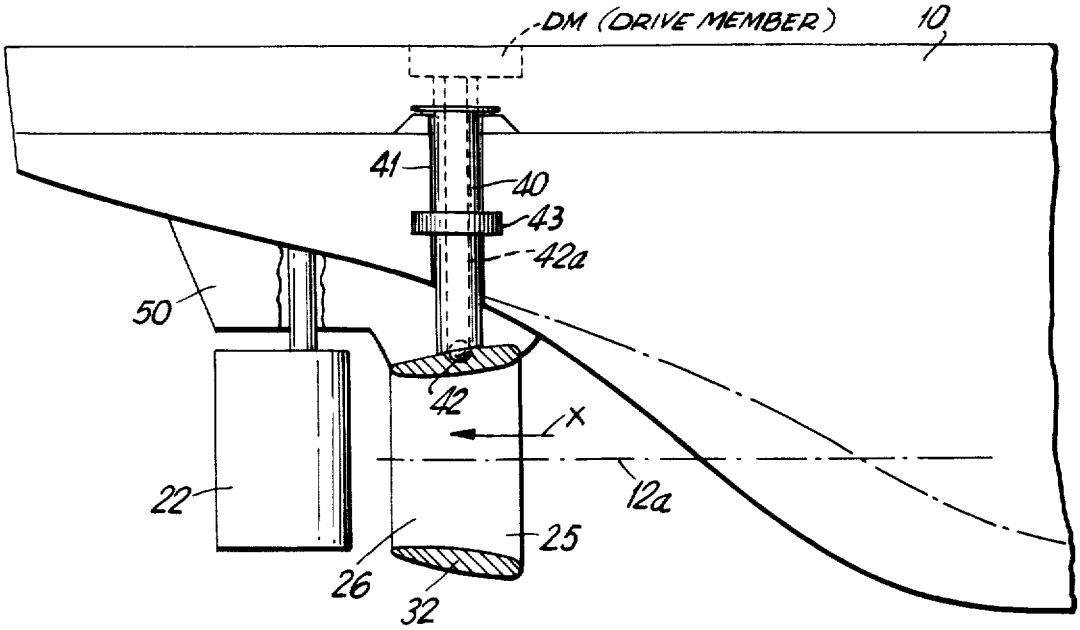
FIG. 2 is a partial side view of a ship embodying the present invention and illustrating the rudder-nozzle arrangement.

Though the nozzle-type shrouds 31, 32 are illustrated connected by a ball-type joint 42 to the shaft 40 so that limited pivotal movement about the shaft axis is possible, it is also possible to connect the shroud rigidly to the shaft with the guide assembly 41 rigidly connected to the ship's body. As indicated in FIG. 2, brake member 43 is provided to secure the pivoted position of the shaft relative to the guide assembly 41, accordingly, it is possible to provide a positive friction engagement of the two parts. This engagement is releasable when it is desired to adjust the angular position of the shroud. There are a number of other ways in which the shaft 40 could be turned around its vertical axis for changing the position of the shroud, for instance a gear arrangement could be provided on the guide assembly 41 in meshed engagement with a gear ring on the shaft 40 so that the meshed engagement permits rotation of the shaft and also locking of the shaft because of the interengagement of the two parts. As pointed out above, the nozzle-type shroud 32 is also designed to effect limited pivotal movement about the horizontal second axis which extends perpendicularly of the vertical first axis of the shaft 40. With the arrangement in FIG. 2 the movement of the shroud 32 about the horizontal second axis can also be locked so that when the desired position of the shroud is reached it can be held and secured in place. The ship's rudder 22 associated with the screw 12 and its nozzle-type shroud 32 are located in the wake of the propeller in the zero position pivoted by at least the same angle relative to the lateral plane of the ship's underwater portion as the nozzle-type shrouds 31, 32.

As can be seen in FIG. 2, a streamlined fairing 50 is located at the stern of the ship's body and is positioned between the nozzle-type shrouds 31, 32 and the associated rudders 21, 22.

Figure 3:
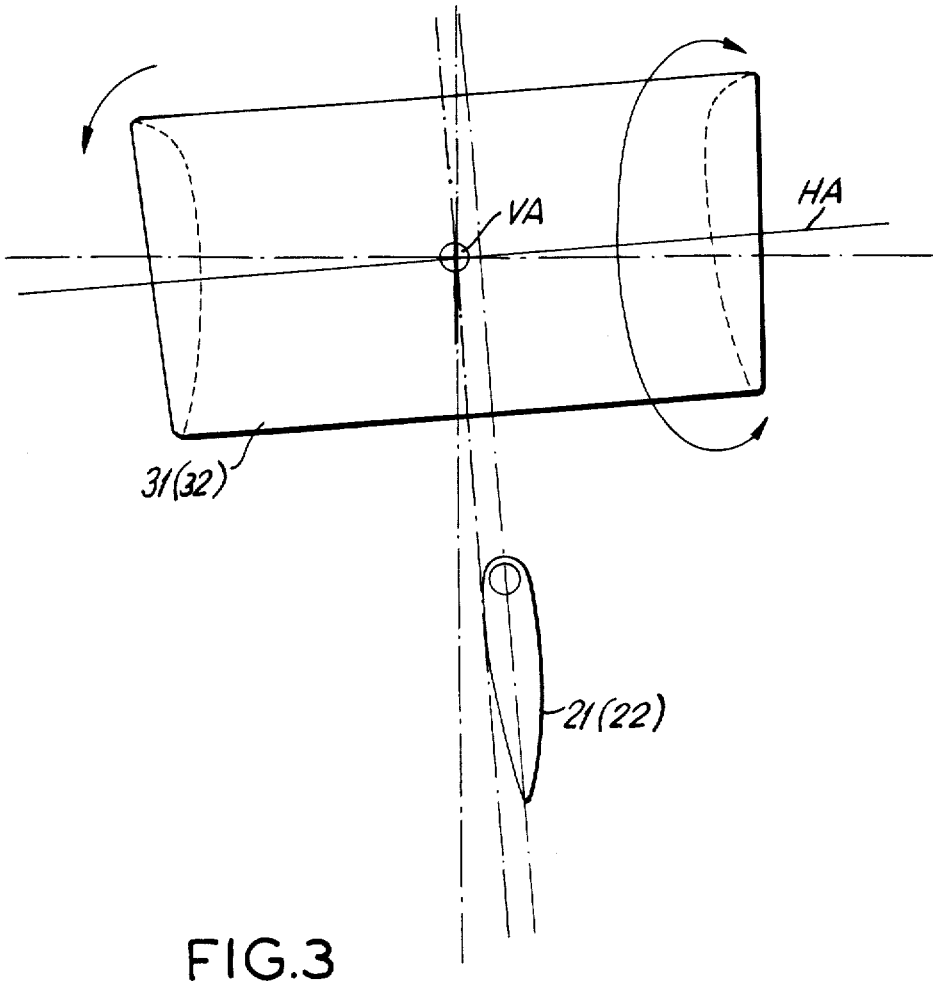
FIG. 3 is a top view of the rudder-nozzle arrangement.

In FIG. 1 it can be seen that the angle of the center line of the nozzle-type shrouds 31, 32 with the axis of the propeller shaft is at least two degrees. With such an angle of pitch of the nozzle-type shrouds relative to the propeller shaft axis, a very high efficiency is attained. In FIGS. 1 and 3 it can be seen that the ship's rudders 21, 22 are disposed in the wake of the propeller in the zero position pivoted by at least the same angle as the angle of the shroud with respect to the axis of the propeller shaft. This angle bears a relation to the lateral plane of the ship's underwater portion in the region of the rudders and propeller. In FIG. 3 the axis through the rudder 21, 22 is offset laterally from the prolongation of the propeller shaft axis. The prolongation of the center lines of the shrouds 31, 32 and of the corresponding rudder 21, 22 are approximately parallel.

In FIG. 3 the first and second pivot axes of the propeller shroud 32 are illustrated in relation to the propeller shaft axis.

Figure 4:
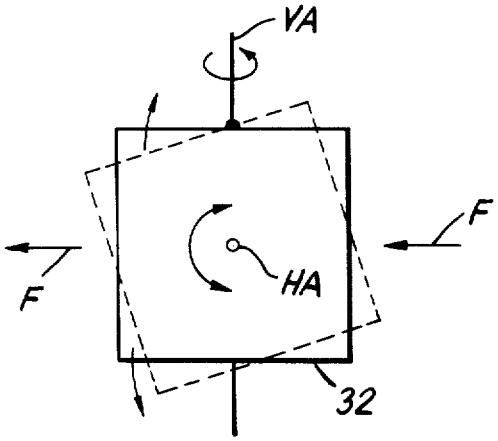
FIG. 4 is a schematic side view of one embodiment for pivotally mounting the nozzle shroud.
Figure 5:
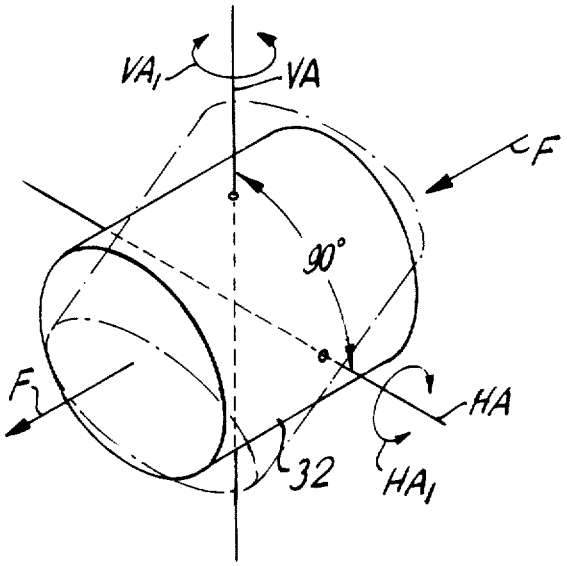
FIG. 5 is a perspective view indicating the manner in which the shroud illustrated in FIG. 4 can be pivoted about its two pivot axes.

In FIGS. 4 and 5 a schematic illustration discloses the shroud of the propeller nozzle unit to be pivotally positionable to achieve the desired conditions.

FIG. 4 is a schematic showing of the shroud 32 pivotally mounted for movement about the vertical axis VA and the horizontal axis HA. Arrows F show the direction of flow through the shroud 32. From the position indicated in full lines, the shroud 32 can be pivoted about both the vertical axis VA and the horizontal axis HA into the position shown in dashed lines. The vertical axis is formed by the shaft 40, note FIG. 2, while the horizontal axis HA is provided by pivot pins supporting the shroud. In FIG. 2, the movement about the horizontal axis is provided by a ball-type joint connection between the vertical shaft 40 and the shroud 32.

In FIG. 5 a schematic perspective view shows the two axes VA, HA extending transversely of the direction of flow F and perpendicularly of one another. In FIGS. 4 and 5 the arrows $VA_1$. $HA_1$ indicate the rotational movement possible about each of the vertical and horizontal axes. A variety of connections between the ship's body and the shroud can be used to achieve the desired pivotal movement of the shroud. FIG. 2 displays one arrangement while FIGS. 6 and 7 exhibit another arrangement for providing the desired pivotal movement of the shroud.

Figure 6:
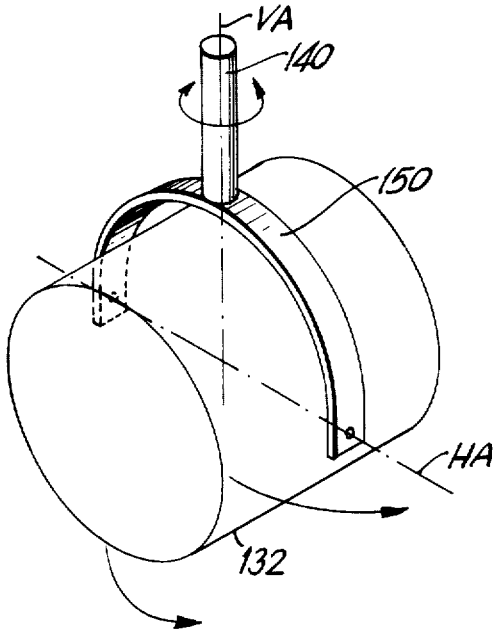
FIG. 6 is a perspective view of another embodiment for pivotally mounting the shroud for movement about two perpendicularly extending axes.
Figure 7:
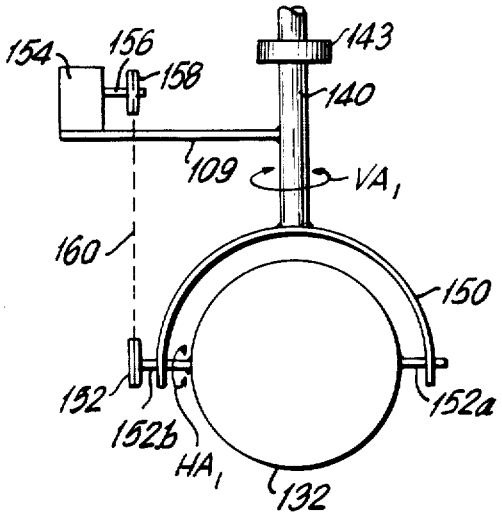
FIG. 7 is a schematic front view of the shroud shown in FIG. 6 on a smaller scale indicating the manner in which the shroud can be pivoted about the two perpendicularly extending axes.

In the schematic perspective view of FIG. 6 the shroud 132 is connected to control shaft 140 by a yoke 150. The yoke 150 is rigidly connected to the lower end of the control shaft 140 and pivotally mounts the shroud by pins 152*a*, 152*b* fitted to the shroud. The axes of the pins define the horizontal axis of the shroud while the shaft 140 defines its vertical axis. A drive wheel 152 is connected to the outer end of one of the pivot pins 152*b*. A drive motor 154 is mounted on the shaft 140 at a location above the yoke. The drive motor 154 drives a shaft 156 on which a drive pulley 158 is attached. A drive member 160 is trained around the drive pulley 158 and the drive wheel 152 so that the shroud 132 can be pivoted about its horizontal axis. When the motor is not operative, the drive shaft 156 is locked against movement and, in turn, via the drive member 160 extending around the drive wheel 154, the position of the shroud relative to the horizontal axis is locked. Similarly, a frictional brake 143 is provided in engagement with the shaft 140 so that movement of the shaft around the vertical axis VA can also be locked. With this arrangement it is possible to pivot the shroud 132 about its horizontal and vertical axes and to lock it in position when the desired location is achieved.

Persons skilled in the art, in view of the above description of the invention, will appreciate that there are a number of different mechanical or electro-mechanical means available for positioning the shroud.

In FIG. 2 the fairing 50 is secured to and extends downwardly from the ship's bottom between the two propeller screw units—rudders. The fairing 50 is fixed to the ship's body above the rudder and the nozzle. The fairing extends rearwardly from above the nozzle to a location above the rudder. The streamlined fairing limits the upper propeller jet region between the nozzle type shroud and the region above the rudder.

While specific embodiments of the invention have been shown and described in detail to illustrate the application of the inventive principles, it will be understood that the invention may be embodied otherwise without departing from such principles.

We claim:

1. Propulsion assembly for use on a ship having an elongated ship's body, said assembly comprising two propellers arranged to be mounted on the ship's body in laterally spaced relation and including an axially elongated propeller shaft for each said propeller having a front end and a rear end with said propeller located at the rear end thereof, said propeller shaft having an axis extending approximately horizontally, a nozzle-type shroud laterally enclosing each said propeller and having an axis extending in the same general direction as the axis of the associated said propeller shaft, means for mounting each said shroud for rotation about an upwardly extending first axis disposed approximately perpendicularly to the axis of the associated said propeller shaft, wherein the improvement comprises that said means for mounting said shroud is arranged for rotating said nozzle-type shroud for limited pivotal movement about a second axis extending perpendicularly of the upwardly extending first axis of said nozzle-type shroud and approximately perpendicularly to the axis of said propeller shaft, a rudder located downstream from each of said nozzle-type shrouds relative to the normal forward movement of a ship's body in the wake of the associated said propeller, said rudder has a zero position, said rudder having an upwarldy extending pivot axis offset laterally from the prolongation of the associated said propeller shaft, and in the zero position said rudder being disposed at least at the same angle with the prolongation of said propeller shaft as said nozzle-type shroud is pivoted relative thereto, and each said nozzle-type shroud having an angular adjustment relative to the elongated approximiately horizontal axis of the associate said propeller shaft of at least two degrees, said means for mounting each said shroud comprises an upwardly extending shaft for each said shroud, a ball-type joint connected to the lower end of said shaft and to said shroud, said upwardly extending shaft arranged to extend into the ship's body, means arranged to be located within the ship's body for rotating said shaft about the axis thereof, means connected to said ball-type joint for rotating said joint about a horizontal axis for pivoting said shroud about a horizontal axis extending perpendicularly of the axis of said shaft, and means arranged for locking said shroud in position for achieving a maximum of the integral of the velocity field established across the entry area in the direction of the nozzle axis, and said locking means is associated with said shaft locking said shaft against rotation about the axis thereof and for locking said shroud against pivotal movement around the horizontal axis extending perpendicualrly of the axis of said shaft.

2. Propulsion assembly, as set forth in claim 1, wherein a guidance sleeve is arranged coaxially with and laterally encloses each said shaft, each said guidance sleeve is arranged to be rigidly connected to the ship's body, each said shaft is rotatable relative to said guidance sleeve and is releasably connected thereto for securing the pivoted position of said nozzle-type shroud and said shaft.

3. Propulsion assembly, as set forth in claim 1, wherein a streamline fairing arranged to be fixed to the ship's body in the region of said nozzle-type shrouds and rudders with said fairing extending in the axial direction of the associated said propeller shafts from above said nozzle-type shrouds to above said rudders for limiting the upper propeller jet region between said nozzle-type shrouds and the region of the associated said rudders.

4. Propulsion assembly for use on a ship having an elongated ship's body, said assembly comprising two propellers arranged to be mounted on the ship's body in laterally spaced relation and including an axially elongated propeller shaft for each said propeller having a front end and a rear end with said propeller located at the rear end thereof, said propeller shaft having an axis extending approximately horizontally, a nozzle-type shroud extending in the same general direction as the axis of the associated said propeller shaft, means for mounting each said shroud for rotation about an upwardly extending first axis disposed approximately perpendicularly to the axis of the associated said propeller shaft, wherein the improvement comprises that said means for mounting said shroud is arranged for rotating said nozzle-type shroud for limited pivotal movement about a second axis extending perpendicularly of the upwardly extending first axis of said nozzle-type shroud and approximately perpendicularly to the axis of said propeller shaft, a rudder located downstream from each of said nozzle-type shrouds relative to the normal forward movement of a ship's body in the wake of the associated said propeller, said rudder has a zero position, said rudder having an upwardly extending pivot axis offset laterally from the prolongation of the associated said propeller shaft, and in the zero position said rudder being disposed at least at the same angle with the prolongation of said propeller shaft as said nozzle-type shroud is pivoted relative thereto, and each said nozzle-type shroud having an angular adjustment relative to the elongated approximately horizontal axis of the associated said propeller shaft of at least two degrees, said means for mounting each said shround comprising an upwardly extending shaft arranged to extend downwardly from the ship's body, a yoke secured to the lower end of said shaft with said yoke straddling said shroud, pin means connected to said shroud and mounted in said yoke for pivotally mounting said shroud about a horizontal axis defined by the axes of said pin means and extending perpendicularly of the axis of said upwardly extending shaft, and means for locking each said shaft including first locking means for locking said shroud against rotation about the upwardly extending axis thereof and second locking means for locking said shroud against rotation about the horizontal axis formed by said pin means.

5. Propulsion assembly, as set forth in claim 4, wherein said pin means comprise a pair of pins extending outwardly from diametrically opposite sides of each said shroud, means mounted on said shaft and in driving engagement with said pins pivotally mounted in said yoke for pivotally moving said shroud about the horizontal axis formed by said pins.

6. Propulsion assembly, as set forth in claim 5, wherein said means for pivotally moving said shroud about the horizontal axis comprising a support secured to said upwardly extending shaft, a drive motor mounted on said support, a driving member driven by said motor, a drive wheel mounted on one said pins, and a member extending between said driving member and said drive wheel on said pins for pivotally moving said shroud.

7. Propulsion assembly, as set forth in claim 6, including means on said shaft for locking said shaft against rotation, and means associated with said drive motor for securing said pins on said shroud against rotational movement.

8. Propulsion assembly for ships comprising an elongated ship's body having a center line extending in the direction between the bow and the stern of said ship's body, a pair of propellers each located on an opposite side of the center line of said ship's body, each said propeller including an axially elongated propeller shaft having a front end and a rear end with said propeller located at the rear end thereof, said propeller shaft having an axis extending approximately horizontally, a nozzle-type shroud laterally enclosing each said propeller and each said shroud having a center axis extending in the same general direction as the axis of said propeller shaft, means for pivoting each said shroud, wherein the improvement comprises that said pivoting means for said shroud includes a first pivoting means for limited pivotal movement of said shroud about an upwardly extending first axis extending approximately perpendicularly of the axis of said propeller shaft, and second pivoting means for limited pivotal movement of said shroud about a second axis extending horizontally and approximately perpendicularly of the axis of said propeller shaft, means for locking said shroud in position for preventing pivotal movement about said first and second axis for achieving a maximum of the integral of the velocity field established across the entry area in the direction of the nozzle axis, a rudder associated with each said propeller shaft and positioned downstream from said nozzle-type shroud with which it is associated relative to the normal forward movement of said ship's body, each said rudder located on an opposite side of the center line of said ship's body and positioned between the center line of said ship's body and the prolongation of said propeller shaft beyond and downstream of said propeller, and each said rudder being offset laterally relative to the prolongation of the axis of said propeller shaft and said rudder having an axis extending in the general direction of said propeller shaft axis and the center axis of said shroud, so that the axis of said rudder forms an angle with the axis of said propeller shaft which is at least the same angle that said nozzle-type shroud is pivoted about said first axis thereof, said first pivoting means comprising an upwardly extending shaft connected to said nozzle-type shroud, a guidance sleeve coaxial with and laterally enclosing said shaft, said guidance sleeve being rigidly connected to said ship's body, said shaft being rotatable relative to said guidance sleeve and being releasably connectable thereto for securing the pivoted position of said nozzle-type shroud and said shaft, said second pivoting means comprising a yoke connected to the lower end of said shaft, horizontally extending pins secured to said shroud and axially aligned on diametrically opposite sides thereof and pivotally mounted in said yoke, and drive means in driving engagement with said pins for selectively pivotally moving said shroud about the horizontal axes of said pins.

9. Propulsion assembly, as set forth in claim 8, wherein said nozzle-type shroud having an angle of pitch relative to the axis of said propeller shaft of at least two degrees.

10. Propulsion assembly, as set forth in claim 9, wherein a streamline fairing is fixed to said ship's body in the region of said nozzle-type shrouds and rudders with said fairing extending in the center line direction of said ship's body from above said nozzle-type shrouds to above said rudders for limiting the upper propeller jet region between said nozzle-type shroud and the region of said rudder.

11. Propulsion assembly, as set forth in claim 8, wherein said drive means for rotating said shroud about the horizontal second axis comprises a support secured to said upwardly extending shaft, a drive moor mounted on said support, a driving member driven by said motor, a drive wheel mounted on one said pins, and a member extending between said driving member on said drive wheel on said pins for pivotally positioning said shroud.

12. Propulsion assembly, as set forth in claim 11, including means on said shaft for locking said shaft against rotation, and means associated with said drive motor for securing said pins on said shroud against rotational movement.

13. Propulsion assembly for ships comprising an elongated ship's body having a center line extending in the direction between thebow and the stern of said ship's body, a pair of propellers each located on an opposite side of the center line of said ship's body, each said propeller including an axially elongated propeller shaft having a front end and a rear end with said propeller located at the rear end thereof, said propeller shaft having an axis extending approximately horizontally, a nozzle-type shroud laterally enclosing each said propeller and each said shroud having a center axis extending in the same general direction as the axis of said propeller shaft, means for pivoting each said shroud, wherein the improvement comprises that said pivoting means for said shroud includes first pivoting means for limiting pivotal movement of said shroud about an upwardly extending first axis extending approximately perpendicularly of the axis of said shaft, and second pivoting means for limited pivotal movement of said shroud about a second axis extending horizontally and approximately perpendicularly of the axis of said propeller shaft, means for locking said shroud in position for preventing pivotal movement about said first and second axes for achieving a maximum of the integral of the velocity field established across the entry area in the direction of the nozzle axis, a rudder associated with each said propeller shaft and positioned downstream from said nozzle-type shroud with which it is associated relative to the normal forward movement of said ship's body, each said rudder located on an opposite side of the center line of said ship's body and positioned between the center line of said ship's body and the prolongation of said propeller shaft beyond and downstream of said propeller, and each said rudder being offset laterally relative to the prolongation of the axis of said propeller shaft and said rudder having an axis extending in the general direction of said propeller shaft axis and the center axis of said shroud, so that the axis of said rudder forms an angle with the axis of said propeller shaft which is at least the same angle that said nozzle-type shroud is pivoted about said first axis thereof, said first pivoting means comprises an upwardly extending shaft, said second pivoting means comprises a ball-type joint connected to the lower end of said shaft and to said shroud, said upwardly extending shaft extending into said ship's body, means within said ship's body for rotating said shaft about the axis thereof, means connected to said ball-type joint for rotating said joint about a horizontal axis, and said means for locking said shroud is associated with said shaft for locking said shaft against rotation about the first axis and for locking said shroud against rotation around the second axis extending perpendicularly of the axis of said shaft.

* * * * *